United States Patent [19]

Fish

[11] 4,325,494

[45] Apr. 20, 1982

[54] SINGLE-BILL CURRENCY DISPENSER

[75] Inventor: Leonard A. Fish, Chicago, Ill.

[73] Assignee: Avco Investment Management Corporation, Greenwich, Conn.

[21] Appl. No.: 49,896

[22] Filed: Jun. 19, 1979

Related U.S. Application Data

[63] Continuation-in-part of Ser. No. 786,760.

[51] Int. Cl.[3] ..... B65H 5/06

[52] U.S. Cl. ..... 221/13; 271/263; 209/534

[58] Field of Search ..... 221/259, 227, 231, 244, 221/197, 198, 287, 13; 271/6, 263, 25, 126, 110, 153, 147, 119; 209/534

[56] References Cited

U.S. PATENT DOCUMENTS

| | | | |
|---|---|---|---|
| 225,974 | 3/1880 | Ecaubert | 271/25 |
| 3,273,884 | 9/1966 | Zahradnik | 271/25 X |
| 3,586,207 | 6/1971 | Brenner | 221/259 |
| 3,795,395 | 3/1974 | Ransom et al. | 271/263 X |
| 3,866,903 | 2/1975 | Eppe et al. | 271/119 |
| 3,937,453 | 2/1976 | Hickey et al. | 271/110 X |
| 3,954,260 | 5/1976 | Morello et al. | 271/263 X |
| 3,964,740 | 6/1976 | Lamb | 221/259 X |
| 4,113,244 | 9/1978 | Ruenzi | 271/127 |

*Primary Examiner*—Stanley H. Tollberg
*Attorney, Agent, or Firm*—Irwin P. Garfinkle; Robert J. McNair, Jr.

[57] ABSTRACT

A single-bill currency dispenser incorporates a self-contained cartridge for storing a quantity of bills of a single denomination, and dispensing the bills singly in response to electrical control signals. The bills are loaded into the cartridge in a vertical stack of bills which may, if desired, be arranged in serial number order, and are dispensed one at a time from the top of the stack. The serial number of the bill next to be dispensed is visible through a window in the top of the cartridge case. A roller engages the topmost bill at the top of the stack and urges it forward to be received by a belt conveyor. Passage of a single bill through the conveyor triggers a switch to indicate that dispensing is occurring, and passage of two or more bills at the same time through the conveyor triggers a second switch, causing the bills to be ejected into an escrow tray. The cartridge is received and locked in place in a host machine, and correspondingly coded mechanical fittings allow insertion of an appropriate cartridge into place in the machine. When a locked case is desired, the case of the cartridge forms a locked self-contained unit, so the cartridge may be removed from the host machine without disturbing the security of the stack.

21 Claims, 10 Drawing Figures

SINGLE-BILL CURRENCY DISPENSER

This is a continuation-in-part application of Fish application Serial No. 786,760, filed Apr. 12, 1977 now abandoned.

BACKGROUND OF THE INVENTION

1. Field of the Invention

The present invention relates to automatic bank machinery, and more particularly to a self-contained single-bill dispenser.

2. Prior Art

In many automatic bank machines, only packets of bills are dispensed, totalling $25, $50, etc. Generally, only two different amounts can be dispensed, and the packets which are dispensed must be specially made up and segregated from each other, requiring considerable time and effort.

Efforts to overcome these disadvantages, by providing a mechanism which can dispense single bills, have resulted only in complicated and cumbersome devices. Some require a source of reduced air pressure or vacuum to pick single bills from a stack of bills. The need for a vacuum limits the use of such a unit to installations where a source of reduced air pressure or vacuum is available, or else a vacuum pump must be contained within the unit itself, adding to the complexity, size and expense of the unit.

Another difficulty encountered in previous designs of single-bill dispensers is that brand new bills either cannot be handled by the units at all, because of the tendency of brand new bills to stick together, or the adjustments which must be made to accommodate brand new bills are very delicate. Also, the adjustments are sometimes different for old bills or for brand new bills, and so it is impractical to use mixtures of new bills and old bills. Therefore, these units are generally restricted to operation with bills which have either been specially prepared for use (by crumpling or the like) or bills which have already been in circulation. The special preparation required for the use of new bills involves time and expense which adds to the costs of using the unit, and when only bills previously in circulation can be handled, there can be no possibility of having the bills in numerical sequence by serial number; the total dollar amount of money represented by a stack of bills can be determined only by carefully counting them one by one. This need for counting represents an additional expense in the use of the apparatus.

Previous designs of single-bill dispensers typically use photocells or other photoelectric means for sensing the dispensing of bills. While such devices are able to sense the presence or non-presence of a bill in the dispensing path, they are insensitive to whether one or several bills are being dispensed simultaneously. Accordingly, dispensing errors can occur. Also, the photoelectric apparatus requires frequent maintenance, to keep the optical surfaces clean and free of dust or deposits.

Previous designs of single-bill dispensers have also been hampered by the lack of security involved with the loading, unloading, counting, etc., procedures which are required in their use. Because of the size and bulk of these units, it is necessary for bank employees or security guards to transport a quantity of cash to the unit and load the cash into the unit at the site where the bills are to be dispensed. This operation typically requires the services of groups of people, for security requirements. Typically, two bank employees are required in connection with the handling of cash because of the lack of suitable controls on the loading and unloading of the dispensing unit.

There is a need for apparatus and methods which overcome the disadvantages of the previous designs.

BRIEF SUMMARY OF THE PRESENT INVENTION

It is a principal object of the present invention to provide a single-bill dispenser which overcomes the disadvantages of the previous designs.

A further object of the present invention is to provide a single-bill dispenser in the form of a closed, locked cartridge adapted to be received in place at a location where the bills are to be dispensed, and transported to and from said place as an enclosed unit.

A further object of the present invention is to provide a single-bill dispenser which can handle brand new bills, so that they can be dispensed in order of their serial number.

Another object of the present invention is to provide a single-bill dispenser in which the bills are held in a magazine in a vertical stack, with the topmost bill of the stack being dispensed, so that inspection of the serial number of the topmost bill, from without the unit, enables the determination of the total number of bills remaining in the stack.

A further object of the present invention is to provide reliable means for sensing when a single bill is being dispensed, and reliable means for sensing when more than a single bill is being dispensed, such means generally not requiring adjustment after the original factory adjustment, and not requiring frequent maintenance.

A further object of the present invention is to provide reliable means for dispensing a single new bill from the top of the vertical stack of new bills.

A further object of the invention is to provide reliable means for dispensing currency which has already been circulated, such as bills with little stiffness, dirty bills, bent corner bills, creased bills, etc. This facilitates use of the invention in branch systems where special new bills cannot be sent to each branch.

Another object of the present invention is to provide a single-bill dispensing apparatus, in which any bills not properly dispensed are accumulated in the same locked compartment as the stack of bills waiting to be dispensed.

A further object of the present invention is to provide a single-bill dispensing apparatus which is adapted to dispense single bills reliably from a stack of bills, down to the last bill in the stack.

Another object of the present invention is to provide a single-bill dispensing apparatus with means for physically or electrically identifying the denomination of bills contained in the dispensing apparatus, so that the dispensing apparatus may be controlled by an external controller in accordance with the denomination of the bill.

These and other objects and advantages of the present invention will become manifest by an inspection of the following description and accompanying drawings.

In one embodiment of the present invention, there is provided a single-bill dispenser having a lockable closed case, means for supporting a stack of bills in said case, a window in said case for revealing the serial number of the topmost bill in said stack, roller means for selectively urging said topmost bill forwardly relative to said stack, a pair of shaped members juxtaposed with the forward edge of said topmost bill for bowing said bill as said bill is moved forwardly, belt conveyor means for conveying said topmost bill forwardly off of said stack, sensing means for sensing the conveying of a single bill from said stack and providing an electrical signal responsive thereto, and selectively operable means for rejecting a bill within said closed case.

BRIEF DESCRIPTION OF THE DRAWINGS

Reference will now be made to the accompanying drawings in which.

DESCRIPTION OF THE PREFERRED EMBODIMENTS

Figure 1:
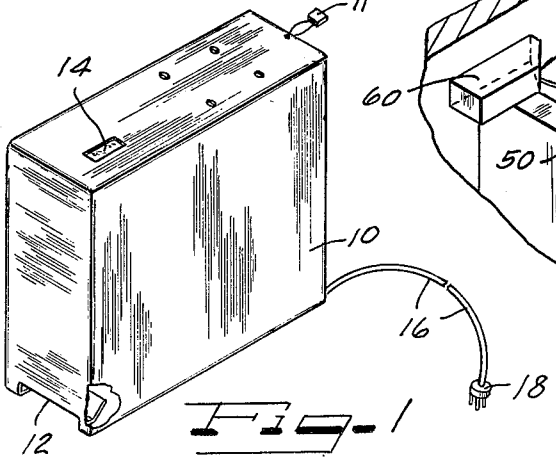
FIG. 1 is a perspective view of a single-bill dispenser incorporating an illustrative embodiment of the present invention.

FIG. 1 illustrates a single-bill dispenser incorporating an illustrative embodiment of the present invention. The dispensing unit has an external case 10 which is preferably formed of a single piece of sheet metal such as aluminum in a single stamping operation. Alternatively, it can be formed of plastic or the like, when a strong external case is not required. The rear wall (not shown in FIG. 1) is sealed with a seal 11 and is locked in place with a lock (not shown), but may be removed when unlocked with a suitable key. An aperture 12 at the lower side of the front wall provides a means for bills to exit from the case, one at a time, and a window 14 at the top wall of the case provides a means for inspecting the serial number of the bill which is topmost on the stack waiting to be dispensed. The dispensing unit may be employed as a cartridge, being received in a receptacle of an automatic bank machine (not shown), which locks the unit in place and makes its rear wall inaccessible. The automatic bank machine, hereinafter referred to as the "host machine", generates electrical signals causing the dispenser to dispense a single bill, and monitors signals produced by the dispenser during its operation.

As described in more detail hereinafter, the dispenser dispenses a single bill in response to each separate signal received from the host machine, as necessary to carry out any program of operation being performed by the host machine. Since automatic bank machines are well known, no detailed description of such machine is necessary. It will be understood however that the host machine has a keyboard or some other data input means which determines the amount of money to be dispensed, and means for producing a separate signal for each bill of each denomination which is to be dispensed. The dispensing unit of FIG. 1 stores and dispenses only a single denomination, and it is contemplated that several similar units will be used with a single host machine, so that any amount of money can be dispensed by providing suitable control signals to a variety of dispensing units of different denomination.

A mechanical coding technique, different for each denomination, such as projections extending from the rear wall of the unit 10 at various locations cooperating with aligned apertures in the receptacle of the host machine, is preferably used, so that only a dispensing unit for the appropriate denomination of bills for a particular receptacle can be received and locked in place relative to the host machine. Alternatively, coded grooves are provided in the bottom plate to identify the denomination.

In still another alternative arrangement, the dispensing unit may be provided with electronic means for generating signals indicative of the denomination of bills contained therein. In such a system, a computer or other data processing apparatus in the host machine detects such signals and controls operation of the dispenser only when bills of the denomination indicated by such signals is required.

The dispensing unit is entirely self-contained, with all of its electrical connections to the host machine being contained in a cable 16 terminating in a plug 18 which is received in a corresponding socket secured to the host machine. It should be apparent that instead of using the cable 16, the plug 18 can instead be mounted directly to a wall of a unit 10 in position to be received in a receptacle at a corresponding position of the host machine. Appropriate positioning of the plug and receptacle can thus serve the dual function of allowing the required electrical connection, and coding the dispensing unit corresponding to the denomination of the bills contained within it.

The apparatus of FIG. 1 may be loaded, either from the front of a host machine, or from the top. Only a small access door need be provided for each cartridge, in the host machine.

Figure 2:
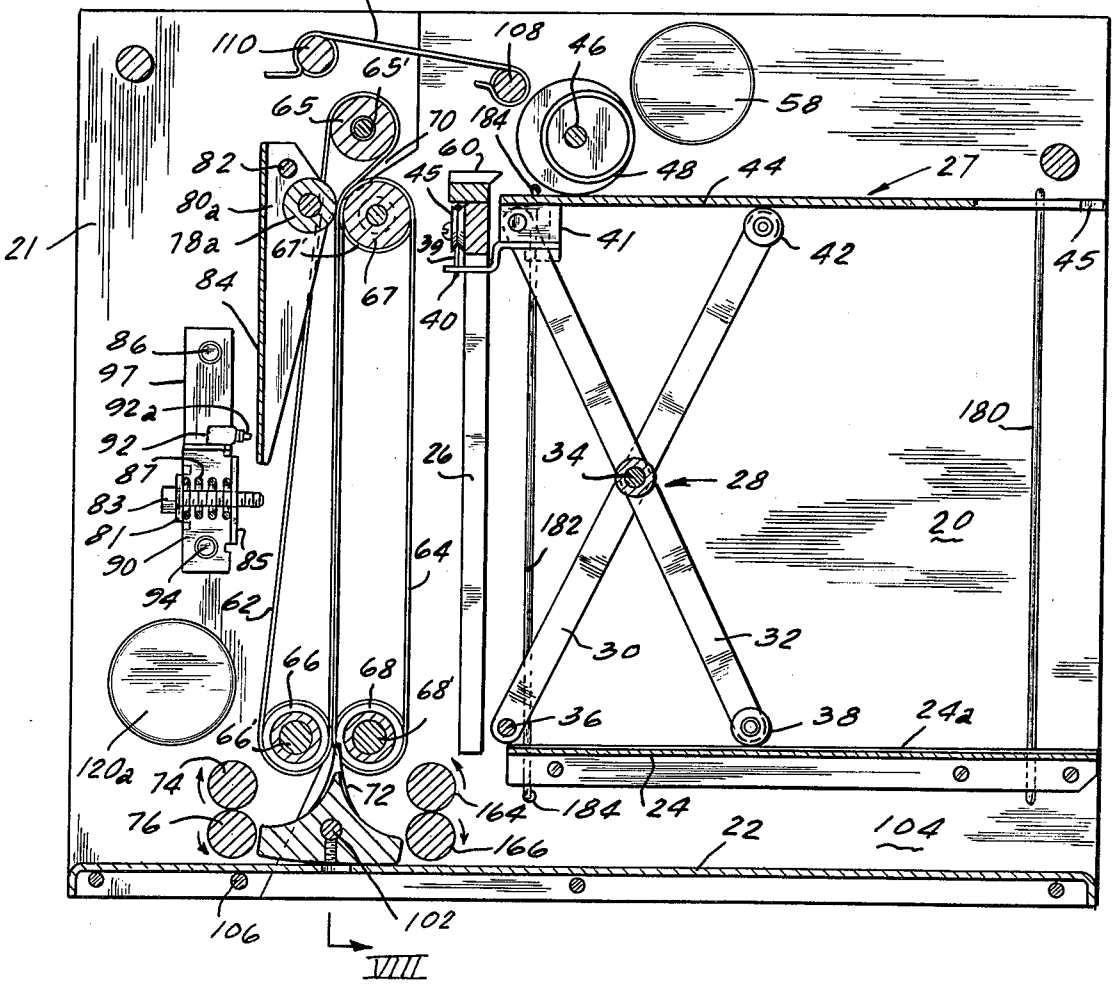
FIG. 2 is a vertical cross-sectional view illustrating details of the apparatus shown in FIG. 1.
Figure 8:
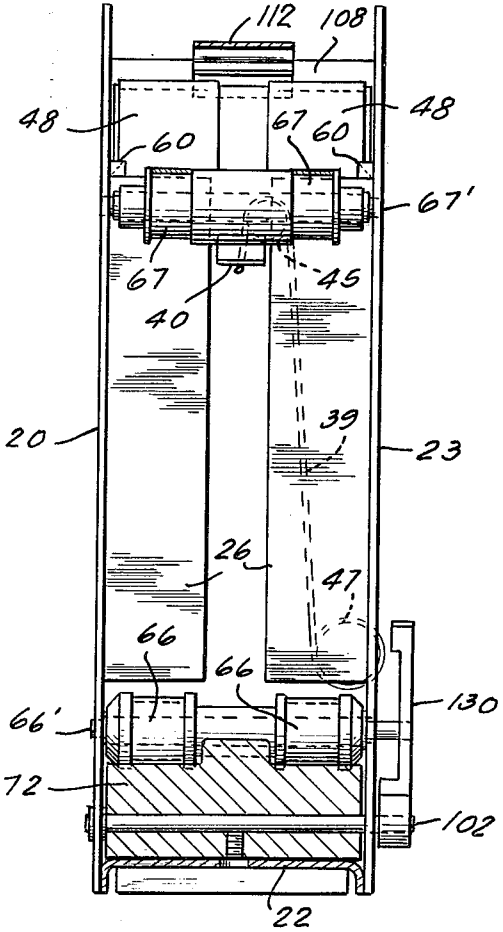
FIG. 8 is a vertical cross-sectional view taken through line VIII—VIII of FIG. 2.

FIG. 2 is a vertical cross-sectional view of the operating mechanism contained within the case 10. The mechanism illustrated in FIG. 2 is removed from the case 10 by sliding it directly rearwardly, once the rear wall has been removed from the case. The operating mechanism incorporates a pair of side walls 20 and 23, with the wall 20 being illustrated in FIG. 2. A number of crossbars hold the side walls parallel to each other. A base panel formed of sheet metal or the like interconnects the bottom edges of the side walls 20 and 23, and the side walls are also connected by a stack panel 24 and an interior vertical wall 26.

A scissors device 28 is composed of two links 30 and 32 pivotally connected by a shaft 34. The bottom end of the link 30 is pivotally connected to the side walls 20 and 23 by a shaft 36, and the bottom of link 32 is provided with a roller 38 which is adapted to freely roll on a pair of ridges **24*a* formed on the upper surface of the stack panel 24, which is preferably formed of sheet metal or the like. The top of the link 32 is pivotally connected to a bracket 41, which is secured to a support plate 44. The upper end of the link 30 is provided with a roller 42 which carries the support plate 44 in a position which is generally horizontal and parallel to the bottom panel 22 and the stack panel 24. The front edge of the support plate 44 engages the rear surface of the vertical wall 26 and slides relative to it. A stack 27 of bills is supported on the support plate 44, which is urged upwardly, and the scissors arrangement including the links 30 and 32**, allows upward movement in a manner which maintains all of the bills of the stack in generally horizontal position.

A finger 40 of the bracket 41 extends forwardly through a vertical slot in the wall 26, and a cord 39 is secured to this finger for urging the support plate in an upward direction. The cord 39 passes upwardly to a pulley 25, mounted near the upper end of the wall 26, around this pulley and down to a lower pulley 47, mounted on the wall 23.

An aperture 49 is provided in the wall 23 adjacent the lower pulley 47, and the cord 39 passes through this aperture and upwardly around pulleys 51, 53, 55 and 57, in succession. The end of the cord 39 is fixed to the side wall 23 at a screw 59.

The pulley 57 is mounted on a bracket 61 which is adjustably supported on a supporting member 63 by means of a threaded support shaft 69. The support member is secured to the side wall 23, and the vertical position of the pulley 57 is adjusted by rotating the shaft 69, relative to the support member 63 into which it is threaded, to adjust the initial tension in the cord 39. The pulley 53 is supported by a bracket 71 to which is secured a second cord 73 which passes over a pulley 75 secured to the side wall 23, and is connected to the upper end of a tension spring 77, the lower end of which is attached to the wall 23. The tension spring 77 increases the tension on the cord 39 as the support plate 44 is lowered, and reduces the tension on the cord 39 as the support plate is raised in position, with the dispensing of bills from the stack. This decrease in force is just enough to compensate for the reduction in weight and friction force of the stack as the bills are dispensed, so that the stack is urged upwardly with a uniform force for any height of the stack.

A shaft 46 is supported between the side walls 20 and 23, and a pair of rubber rollers 48 are eccentrically supported on the shaft 46. The axes of the shaft 46 and rollers 48 are offset by 0.050 inch or about 1.27 mm. The rollers 48 are shown in perspective view in FIG. 5, in association with a bill 50 which represents the topmost bill of the stack 27 supported by the support plate 44. The second bill 52 is directly under the topmost bill, and represents the next bill to be dispensed after the bill 50 is dispensed. The shaft 46 is connected to a gear 54 which is in engagement with a driving gear 56 rotated by a motor 58.

Figure 4:
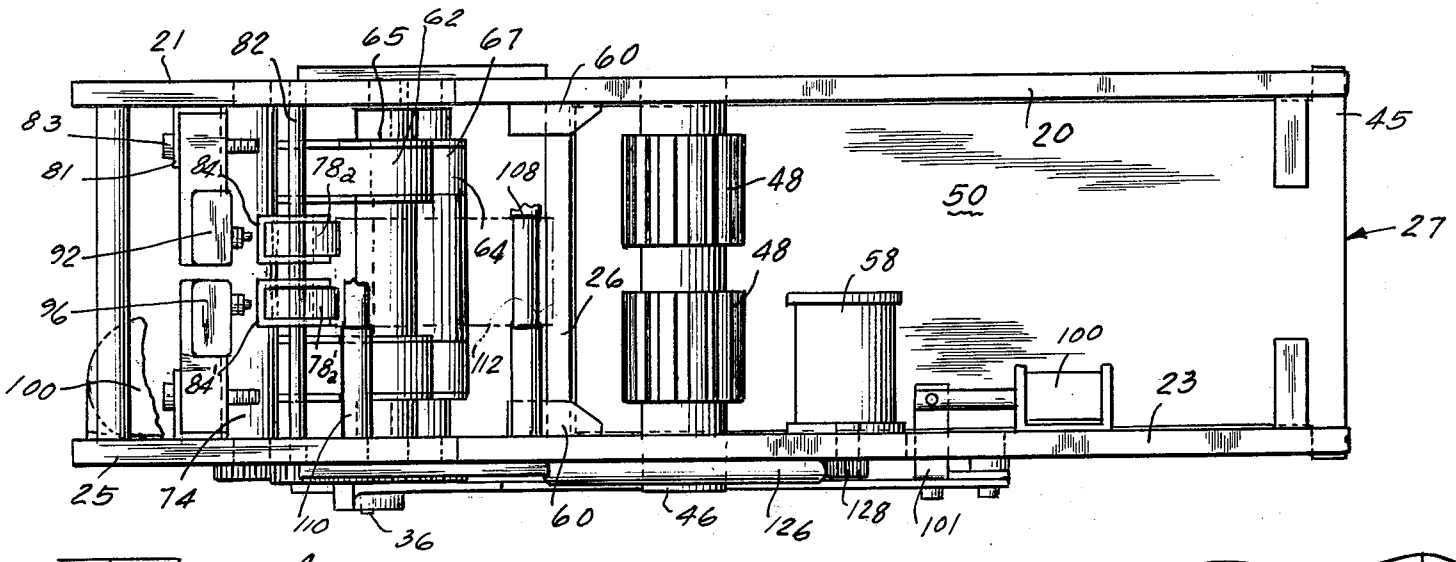
FIG. 4 is a plan view of the operating mechanism of FIG. 3.
Figure 7:
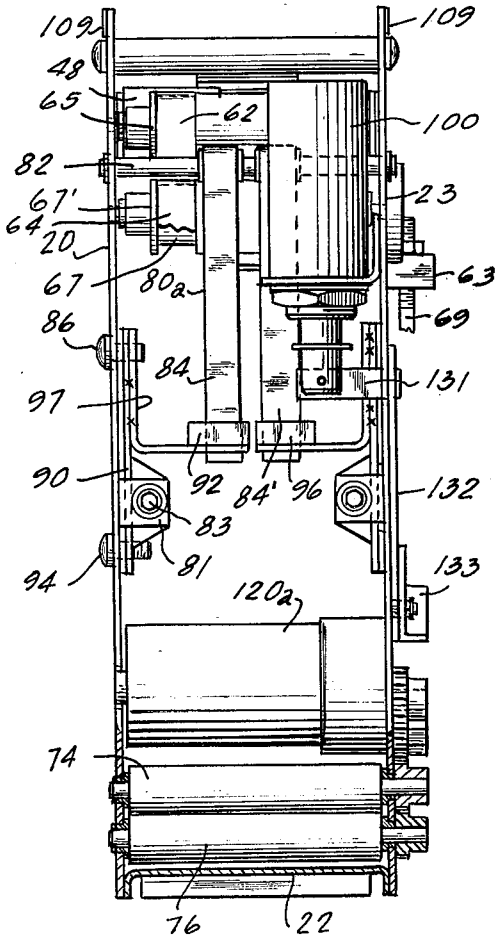
FIG. 7 is a front view of the operating mechanism of the apparatus of FIG. 3.

When a dispensing operation is called for, the shaft 46 is rotated in a clockwise direction as seen in FIG. 2, and the rollers 48 urge the topmost bill 50 leftwardly. Because of the eccentric nature of the rollers 48, the support plate 44 is forced downwardly, and then released, so that any tendency for static friction to cause binding of the support plate 44 is overcome. The front edge of the bill is urged into engagement with a pair of shaped members 60, which are adapted to effect a separation of the topmost bill 50 from the underlying bill 52. The topmost bill then continues to move leftwardly, and is gripped by a belt conveyor having two pairs of belts 62 and 64 which are supported on a plurality of pulleys 65–68. The pulleys 65–68 are supported by shafts 65′–68′ journalled in the side walls 20 and 23, and they are driven by a motor (not shown) so that the belts 62 and 64 move downwardly together where they are in contact. The bill being dispensed is received in the nip 70 of the rollers, and passes downwardly between the belts 60 and 62 until it reaches the area just below the pulleys 66 and 68. There it engages a surface of a diverter unit 72, which normally urges it leftwardly between a pair of exit rollers 74 and 76, from whence it emerges through the aperture 12 (FIG. 1). As best seen in FIGS. 4 and 7, two pairs of belts 62 and 64 are provided, for gripping and feeding both side margins of a bill being dispensed.

Two rollers **78*a* and 78*b* bear against the shaft 67′, and both rollers move away from this shaft in response to the passage of a bill over the shaft 67′**.

The roller **78*a* is mounted on a bracket 80*a* which is pivotally connected to the side walls 20 and 23 by a shaft 82. The bracket 80 has an arm 84 which extends downwardly to a position opposite the actuator 92*a* of a miniature switch 92, so that leftward movement of the arm 84 beyond a certain point causes the switch 92 to close. The switch 92 is secured to a bracket 97, which is pivotally mounted on the side wall 20 by means of a pin 86. A lower bracket 90 underlies the bracket 97 and is fixed to the wall 20 by pins 86 and 94. The bracket 90 has a tab 81 extending outwardly from the wall 20. The tab 81 has an aperture for passing the threaded shaft of a screw 83, and the end of the screw 83 is threaded into a threaded bore provided in a tab 85 secured to the bracket 97. A spring 87 surrounds the shaft of the screw 83, and urges the tabs 81 and 85 apart, tending to rotate the switch 92 in a counterclockwise direction about the pin 86. Screwing the screw into the threaded aperture of the tab 85** forces the switch to move in a clockwise direction, and thus controls its position.

The roller **78*b* is mounted in corresponding fashion, and cooperates with a switch 96, which is mounted in an adjustable position by apparatus identical to that described for the switch 92, except that its adjustment mechanism is secured to the side wall 23**.

The arm 84 is positioned, relative to the actuator **92*a*, so that the switch 92 is operated when a single bill passes over the shaft 67′. The arm 84′ is positioned, relative to the actuator of the switch 96, so that the switch 96 is closed when more than a single bill passes over the shaft 67′. The switches 92 and 96 therefore determine both the time at which a single bill passes into gripped relationship with the belts 62 and 64**, and also whether more than one such bill is being gripped.

When the switch 96 is closed, indicating an incorrect condition of feeding multiple bills, a solenoid 100 (FIG. 3) is actuated, which causes the diverter 72 to shift its position. The diverter 72 is mounted for rotation about a shaft 102 supported between the side walls 20 and 23, and the shaft 102 is rotated by a cam lever arm 130, secured to the shaft 102 on the exterior of the wall 23. The solenoid 100 is secured to the wall 23 and, when energized, pulls upwardly on an actuator arm 131. The arm 131 is L-shaped, and the free end of the L-shaped arm extends through a slot in the wall 23 and is connected to the upper end of a link 132 on the outside of the wall 23. The link 132 is pivoted, at its lower end to one end of an operating lever 133, pivotally supported on the wall 23 by a pin 135. The other end of the operating lever 133 bears on the cam lever arm 130, so that actuation of the solenoid 100 urges the link 132 upwardly, rotating the lever 133 in a clockwise direction, and forcing the cam lever 130 leftwardly to rotate the shaft 102. When the shaft 102 is thus rotated, the upper pointed end of the diverter 72 lies forwardly of the space between the belts 62 and 64, so that bills descending downwardly between the two belts 62 and 64 engage the rearward surface of the diverter 72, and are diverted into the escrow compartment 104. The solenoid 100 is preferably continuously actuated until deactuated by means of a signal from the host machine. Thus, the shaft 102 remains in its diverting position for long enough to insure that the multiple bills detected by the closing of the switch 96 are all diverted into the escrow compartment 104.

The switch 96 is connected with the host machine (by means not shown), so that the host machine is informed that its command to dispense a bill has not yet been complied with. This causes the host machine to generate an additional signal, which again starts the shaft 46 rotating, in a second attempt to dispense a single bill. Each time the switch 92 is closed, the power to the motor 58 is interrupted, so that only a single bill is dispensed in response to each signal. By the time the switch 92 is closed, the bill is already received between the belts 62 and 64, so that the rotation of the rollers 48 is not required to carry the dispensed bills out between the exit rollers 74 and 76, or into the escrow compartment 104, as necessary. The drive to the belts 62 and 64 lasts at least as long as necessary to insure that the bill passes completely into the escrow compartment 104 or out through the exit rollers 74 and 76. If desired, the motor for moving the belts 62 and 64 may be operated continuously, although it is more efficient to energize this motor only when a signal has been received from the host machine indicating that a bill is to be dispensed.

In order to facilitate inspection of the interior of the machine, and also to clear any jams which may occur in a vicinity of a belt mechanism, the forward portion 21 of the side wall 20 (and the forward portion 25 of the side wall 23) is hinged to the base plate 22 about a shaft 106. A pin 108 interconnects the upper edge of the side wall 20 and 23, and a pin 110 interconnects the upper edges of the forward portions 21 and 25 and a spring clip 112 is received over the top of the pins 108 and 110 to maintain the side walls in assembled condition. The pins 108 and 110 are each provided with a central groove for receiving the clip, so that perfect alignment of the forward and rear parts is assured when the clip is in place. A tab 109 is secured to each of the forward portions, and overlaps the side walls to assist in alignment when the parts are assembled. If it is desired to inspect the interior of the belt mechanism, or to replace the belts 62 and 64, the spring clip 112 is easily removed from the pins 108 and 110, after which the forward portions 21 and 25 can be tilted forwardly to spread apart the belts 62 and 64.

The rearward end of the operating mechanism illustrated in FIG. 2 is open, when the rear wall of the case has been removed, so that the space above the support plate 44 is accessible to an operator. During loading, the operator depresses the support plate 44 downwardly by manual pressure, inserts a stack of bills on the support plate 44, and then allows the support plate to rise, upwardly against the roller 48 by the force of the spring 77. The bills are positioned on the support plate 44 with the serial numbers up so that the serial number of the topmost bill is always visible through the window 14 in the top wall of the case 10.

The mechanism of the present invention works effectively with brand new bills, so that the stack 27 loaded into the unit can be brand new bills which have their serial numbers in numerical sequence throughout the stack. A record may be made of the topmost and bottommost serial number of the bills in the stack, so that the number of bills can be calculated simply by subtracting one serial number from the other. The number of bills remaining in the stack at any time can also be determined by observing the topmost serial number and making a subtraction, using the serial number of the bottommost bill and the serial number observed on the topmost bill. By this means, the number of bills remaining in the stack can readily be determined by anyone at the site of the dispenser, without interfering with the security of the dispenser or its contents.

Since the unit is a self-contained cartridge, it can be safely handled by a single security guard. Since the guard cannot gain access to the interior of the cartridge, there is no need for a dual system, using two or more people. Since the back plate can be removed only by the use of a key, special security measures are required only at the place where the cartridge is serviced, which is preferably at a bank or the like, and not at the site of the host machine.

The size of the escrow compartment 104 is relatively small compared with the size of the magazine above the support plate 44 because of the reliability of the dispensing mechanism incorporating the rollers 48 and the shaped members 60. Since only relatively few bills find their way into the escrow compartment 104, a large-size escrow compartment is not required.

The scissors mechanism 28 is shown at a relatively elevated position in FIG. 2. During the loading operation, the scissors mechanism is lowered considerably from the position shown in FIG. 2, so that the initial stack of bills and the support plate can include as many as a thousand bills, in the embodiment illustrated. The number of bills in the stack can be increased as much as desired by providing a mechanism for urging the stack upwardly with a constant force, since gravity forces are not involved in the stack out-feed operation. The support plate is held in its lower position by a latch 142 (FIG. 3).

Figure 3:
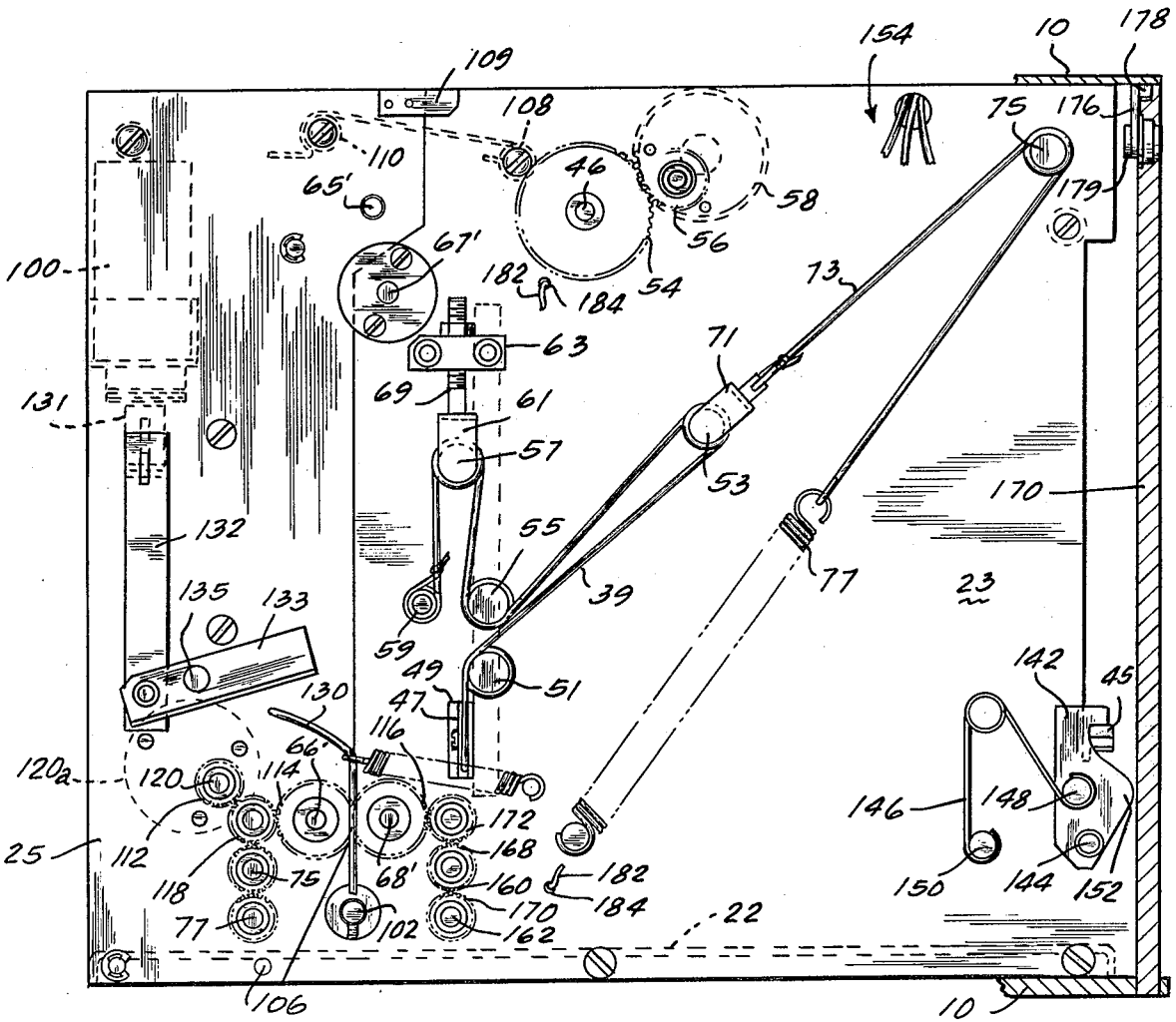
FIG. 3 is a side elevation of one side of the operating mechanism of the apparatus of FIG. 1, with the case removed.

Referring now to FIG. 3, a side elevational view of the apparatus is illustrated, showing the side wall 23 which is not seen in FIG. 2. The shafts 65' through 68' are journalled in apertures of the side walls 20 and 23, as shown, and gears 114 and 116 are connected to the shafts 66' and 68', meshing with each other when the unit is in assembled condition as illustrated. A transfer gear 118 is in engagement with the gear 114, and a drive gear 120 which is supported on a shaft 112 is driven by a motor **120*a*. By this means, all four of the belts 62 and 64 are driven by their respective pulleys 66 and 68. Additional gears are mounted on shafts 75 and 77 and are in engagement with each other, and with the gear 118, so that the exit rollers 74 and 76, mounted on the shafts 75 and 77, are rotated for positively ejecting a bill from the unit. The shaft 46 is also journalled in the side wall 20, and the gear 54 is mounted on the shaft 46**.

A pair of additional shafts 160 and 162, supporting rollers 164 and 166, respectively, are also journalled between the side walls 20 and 23, and are rotated by meshing gears 168 and 170 (FIG. 3). A transfer gear 172 connects the gear 168 to the gear 116. The rollers 164 and 166 provide a positive drive for bills diverted into the escrow compartment 104.

The support plate 44 has a finger 45 which extends laterally away from the end of the support plate 44 for a distance slightly beyond the outer surface of the side wall 23. The latch 142 is pivotally supported on the wall 23 by means of a pin 144 and the latch is biased for rotation in a clockwise direction by a spring 146, one end of which is attached to the latch 142 by a pin 148, and the other end of which is secured to a pin 150. The latch 142 is adapted to engage the finger 45 when the support plate 44 is manually moved downward to its lower position for loading. After the stack is loaded, manual pressure on the outer surface 152 of the latch 142 releases the latch and allows the platform 44 to rise until the topmost bill comes into contact with the rollers 48.

A group of wires 154 shown in FIG. 3 connect the motors, switches and solenoids with the cable 16 (FIG. 1).

Figure 5:
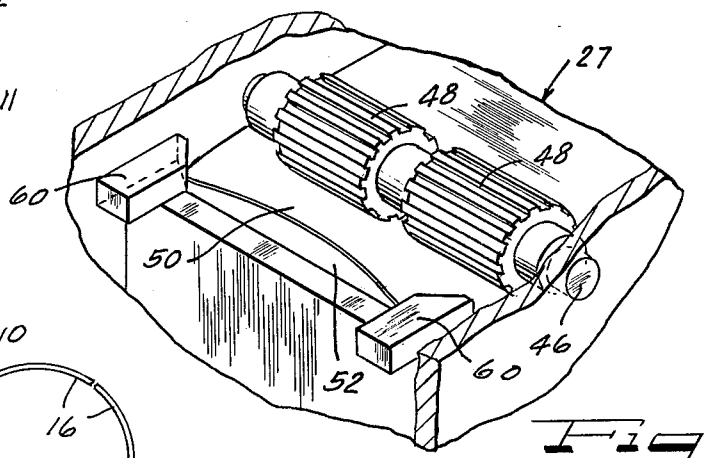
FIG. 5 is a perspective view of a portion of the apparatus illustrated in FIG. 4.

Referring to FIG. 4, which illustrates a top view of the operating mechanism, the rollers 48 are shown in position over the topmost bill 50 in the stack. The shaped members 60 act somewhat like a funnel on the forward edge of the topmost bill, to tend to bow the topmost upwardly in the center, as illustrated in FIG. 5. This occurs as the stack is moved upwardly by means of the spring 77 and the scissors arrangement 28, as a previous bill is dispensed. The shaped members 60, best shown in FIGS. 2, 3 and 5, are secured to the top of the vertical wall 26, which is in alignment with the plane of the topmost bill 50, and also in alignment with the lateral side margins of the bill 50. The end of each shaped member 60 which faces rearwardly (toward the stack 27) has a beveled or angled surface, such that a line normal to the surface is inclined downwardly and rearwardly and toward the center line of the stack. These surfaces of the two shaped members engage the forward corners of the topmost bill 50 and tend to bow it in response to either upward or forward movement of the stack 27.

The scissors arrangement and the spring 77 insures that a substantially constant force urges the topmost bill against the rollers 48, and the rotation of the rollers 48 urges the topmost bill forwardly, which drives the leading edge of the topmost bill against the shaped members 60 to further accentuate the bow illustrated in FIG. 5. As the rollers 46 continue to turn, the leading edge of the topmost bill flips over the shaped members 60, and assumes a relatively flat condition as it enters the nip 70. As the leading edge of the bill 50 flips over the shaped members 60, it snaps the forward end of the bill 50, and causes it to break away from the second bill 52 if there is any tendency for the two bills to stick together. Once the top bill 50 has begun to move relative to the second bill 52, it is easily urged forwardly by the rollers 48, and there is substantially no tendency for the second bill 52 to also move forward. Whatever forward force is imparted to the second bill 52, through friction with the top bill 50, is resisted as the leading edge of the second bill 52 engages the shaped members 60.

Figure 6:
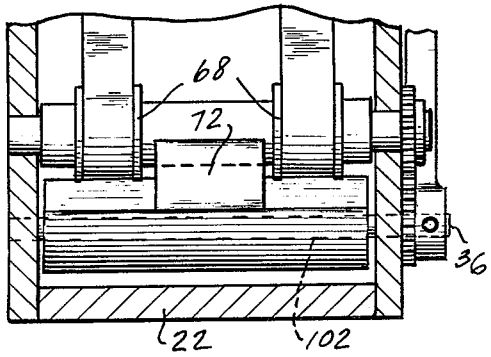
FIG. 6 is a cross-sectional view taken in the plane VI—VI of FIG. 2.

FIG. 6, which is a vertical cross section of a portion of the apparatus illustrated in FIG. 2, shows the vicinity of the bottom of the belts 64 and the diverter 72. The diverter extends upwardly into the space between the belts 64 (and the belts 62) so that it is free to pivot without interfering with the belts.

FIG. 7 illustrates the front view of the operating mechanism, and shows in particular the manner in which the switches 92 and 96 are mounted on the side walls 20 and 23 of the apparatus. Each is mounted on an independent bracket, each bracket being separately adjustably by a screw, so that position of the bracket may be adjusted by rotating its screw.

It is apparent from the foregoing that the apparatus of the present invention comprises a convenient means for storing a stack of bills, and dispensing them singly in response to electrical signals. The electrical circuit for energizing and de-energizing the motors and the solenoid will be obvious to those of ordinary skill in the art, from the above description, and therefore need not be described in detail.

The feed rollers 48 are each preferably provided with a ribbed rubber sleeve, to maximize the friction between the rollers and the topmost bill. Alternatively, soft gum rubber rollers may be used. The spacing of the feed rollers behind the leading edge of the topmost bill is critical, and the preferred spacing is about one-third of the standard width of a United States bill, when standard United States currency is being dispensed. When other currency is dispensed, with different size bills and/or different weight paper, the best location for the feed rollers can readily be determined by simple experimentation. With this spacing, the bowing effect which insures dispensing only a single bill, has its most efficient effect in starting the top bill moving relative to the second bill.

The security requirements in the use of the apparatus of the present invention are greatly reduced in comparison with the previous devices, partly because the apparatus is adapted to use brand new bills, in serial number order. The number of bills contained in the unit at any time can be determined from inspection of the serial number of the topmost bill, as the bills are dispensed from the top of the stack. The means for detecting a dispensing operation for one, or more than one bill, is extremely sensitive, and relatively noncritical in its adjustment, and insures that only a single bill at a time is dispensed by the apparatus. If more than one bill is delivered to the belt conveyor, an unusual condition appearing only when there is an extraordinary stickiness between two bills in the stack, an extremely sensitive detector is operated to divert the multiple bills into the escrow tray with reliability and certainty.

Because of the small size and compactness of the unit, it is easily transported and, if desired, extra cartridges may be maintained in a safe place at the site of the host machine, to facilitate repair procedures by substituting the extra unit for a damaged one. For example, a latching relay can be provided, actuated in response to a control signal from the host machine, to close an energizing circuit to the motor 58, such relay being deactuated by closing of the switch 92. A latching, delayed opening relay, also actuated by the control signal, can be provided for operating the drive to the shaft 122, with this relay deactuated a given time after both switches 92 and 96 have opened. Another delayed opening relay, actuated by closing of the switch 96, and operative to energize the solenoid 100, is also deactuated a given time after both switches open.

The removable back wall 170 is shown in FIG. 3. A portion of its bottom margin is received in an aperture or slot 172 in the bottom plate 22, and a key lock 74 is positioned near its upper margin. Operation of the lock moves a tab 176 into and out of blocked relationship behind a depending stop 178. The back wall 170 is easily removed, once the lock is unlocked.

To facilitate upward movement of the stack 27, as the bills are dispensed, a ridge 180 is formed on the inside surfaces of the side walls 20 and 23 near the rear end of the stack compartment, and a pair of wires 182 are mounted to the inside surfaces of the side walls 20 and 23 near the forward end of the stack compartment. The ends of the wires 182 pass to the outside of the side walls 20 and 23 through apertures 184, where their ends are secured. Both the ridges and the wires accomplish the same purpose, viz., to provide a bearing for reducing as much as possible friction between the stack 27 and the side walls.

Figures 9, 10:
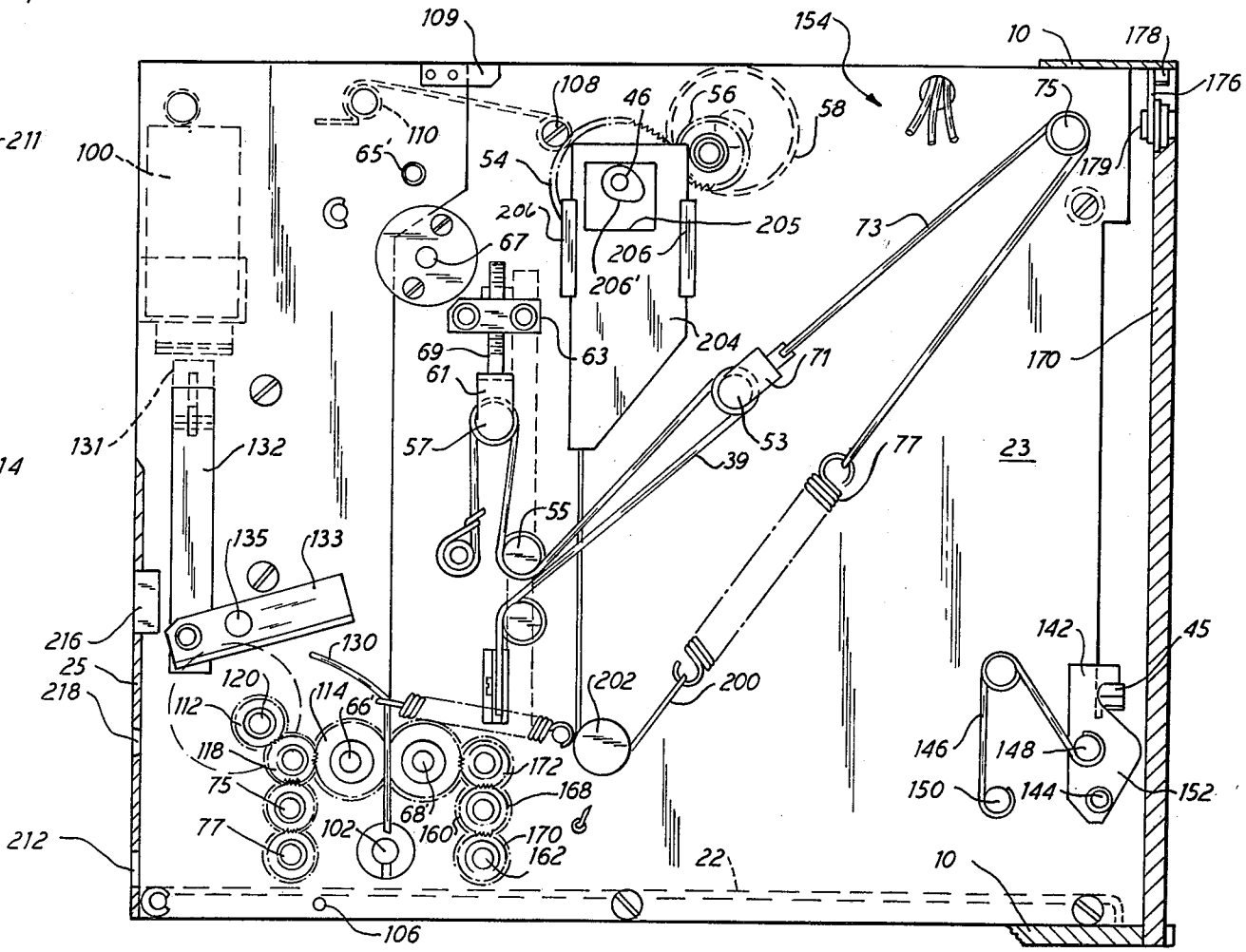
FIG. 9 is a view of an alternative embodiment of the present invention.
FIG. 10 is a view of the case of an alternative embodiment of the dispenser.

Referring now to FIG. 9, an alternative embodiment of the present invention is illustrated. The parts which correspond to similarly numbered parts in FIG. 3 have the same function as described above. The bottom end of the spring 77, however, is not fixed to the side wall, however, but is instead connected to one end of a cord 200, which passes around a pulley 202 and then upwardly, where its other end is connected to a cam follower member 204. The cam follower member 204 is mounted for vertical sliding movement, outside the wall 23, by a pair of guides 206 secured to the wall 23. The member 204 has an aperture 205 which receives the outer end of the shaft 46, to which is secured a cam 206. When the shaft rotates, the cam 206 engages the upper side of the aperture 205, and the member 204 is jogged up and down, imparting a cyclical increase and decrease in the tension of the spring 77, resulting in a cyclical increase and decrease in the upward force applied to the stack 27 by the stack platform 44. This serves to overcome any frictional forces which tend to prevent the stack from moving upwardly sufficiently, after dispensing each bill, to maintain contact between the uppermost bill 50 in the stack 27 (even when only a single bill remains in the stack). The orientation of the cam 46 is preferably set so that the maximum upward force is applied to the stack as the stack 27 reaches its greatest elevation, i.e., the eccentric roller 48 is oriented at its highest, relative to its shaft 46.

The mechanism including the cord 200, the follower member 204 and the cam 206 may be referred to as a jogging mechanism. When such a jogging mechanism is employed, single bills are dispensed with increased reliability for all conditions of currency which may make up the stack. Thus, in the embodiment of FIG. 9, as well as that of FIG. 3, the topmost bill 50 in the stack 27 is in continuous engagement with the feed roller 48.

The preferred form of the roller 48 is one which has a circular cylindrical surface of soft gum rubber, in order to increase the friction between the roller and the topmost bill in the stack.

Referring to FIG. 10, a rear view of an alternative embodiment of the dispenser is illustrated. As shown in FIG. 10, a cartridge 211 is provided, having a slot 212 in the wall 214, for the dispensing of single bills, corresponding to the slot 12 of FIG. 1. An electrical connector 216 is supported in alignment with an aperture in the wall 214. The connector is preferably supported by a bracket or the like (not shown) on the interior of the cartridge 211, so that it cannot be removed from the outside of the cartridge. Adjacent the connector 216 is a small aperture 218. The cartridge 211 is adapted to be placed into a given position in relation to a host machine (not shown), such as an automatic teller machine, and a pin provided on the host machine enters the aperture 218 only when the cartridge is correctly positioned, after which the cartridge may be slid so that the connector 216 comes into connected relationship with a corresponding connector supported on the host machine. The pin holds the connector 216 away from connected position until the position is correct. The aperture is preferably chamfered, as shown, to facilitate alignment and insertion. Preferably, each of the cartridges such as the cartridge 211 have their aperture 218 in a different location, which location is coded in relation to the denomination of bills contained in the cartridge. For example, cartridges for $5 bills may have their apertures 218 at the left side, cartridges for $10 bills may have their apertures in the center, etc.

Preferably, the cartridges are formed in such a way that the stack of bills within is completely enclosed, when the wall 170 is in place and locked. That is, with the wall 170 locked, there is no way, without energizing the dispensing mechanism, to gain access to the stack and remove one or more bills from it. The cartridge may thus be handled, even when full of money, by a single person, without compromising the security of the contents.

It will be apparent that various additional modifications and additions may be made in the apparatus of the present invention without departing from the essential features of novelty thereof, which are intended to be defined and secured by the appended claims.

What is claimed is:

1. A dispenser for dispensing sheets of currency one sheet at a time, comprising means for supporting a stack of currency sheets, a feed roller having eccentric means engaged with the topmost sheet in said stack, constant force pressure means for pressing said stack into contact with said feed roller, means for rotating said feed roller for urging said topmost sheet forwardly relative to said stack, means for sensing the advancement of said topmost sheet for de-energizing said feed roller in response to said advancement, and conveyor means for carrying said advanced topmost sheet to an exit port to dispense said sheet.

2. Apparatus according to claim 1, wherein said pressure means comprises a platform for supporting said stack, and resilient means for pressing said stack into contact with said feed roller by urging said platform toward said feed roller.

3. Apparatus according to claim 2, wherein said resilient means includes parallel motion means, comprising a scissors linkage supporting said platform, whereby the plane of said platform remains parallel to a reference plane, and bearing means for facilitating motion of said stack.

4. Apparatus according to claim 1, wherein said conveyor means carries said sheet downwardly from a point spaced forwardly of said feed roller, and wherein said sensing means comprises means located adjacent the downward path of said sheet for sensing the thickness of a sheet being advanced from said stack, to provide an indication responsive thereto.

5. Apparatus according to claim 4, including means responsive to said indication for interrupting the rotation of said feed roller.

6. Apparatus according to claim 4, including second sensing means juxtaposed with the first said sensing means for sensing the thickness of two or more sheets being simultaneously advanced from said stack, for providing an indication responsive thereto.

7. Apparatus according to claim 6, including diverter means for diverting a sheet into an escrow compartment and preventing dispensing of said sheet in response to the indication of said second sensing means.

8. Apparatus according to claim 1, including a pair of shaped members juxtaposed with the corners of the leading edge of said topmost sheet, said shaped members being shaped to cause the leading edge of said topmost sheet to bow upwardly at its center and then to snap over said shaped members in response to forward motion of said sheet.

9. Apparatus according to claim 8, wherein said pair of shaped members are shaped to cause the leading edge of said topmost sheet to bow upwardly at its center in response to movement of said stack toward said feed roller.

10. Apparatus according to claim 1, including a vertical wall in engagement with the leading edges of all of the sheets in said stack, the upper end of said vertical wall being aligned with the surface of said topmost sheet, and said roller engaging said topmost sheet at a location spaced rearwardly from the leading edge of said sheet by approximately one third of the width of said sheet.

11. A single sheet dispensing cartridge for a currency dispensing machine comprising a completely enclosed locked enclosure for enclosing a stack of currency, and electrically operated means within said enclosure for dispensing single sheets from said stack through a dispensing aperture in said enclosure, said cartridge being replaceably received in fixed position relative to an automatic banking machine.

12. Apparatus according to claim 8, wherein said shaped members are each provided with a surface juxtaposed with the leading edge of said topmost sheet, said surface being normal to a line extending downwardly and rearwardly relative to said stack.

13. Apparatus according to claim 2, including shaft means mounted in fixed relationship relative to said stack, and means for rotating said feed roller eccentrically relative to said shaft.

14. Apparatus according to claim 1, wherein said feed roller is provided with a plurality of spaced parallel ribs spaced around the periphery of said roller.

15. Apparatus according to claim 1, wherein said conveyor means includes a downward conveyor for conveying said sheet downwardly from a point spaced forwardly of said feed roller, an exit conveyor adjacent the lower end of said downward conveyor for conveying said topmost sheet forwardly from the lower end of said downward conveyor toward said exit port, and a reject conveyor juxtaposed with the bottom end of said downward conveyor for selectively conveying said topmost sheet from the lower end of said downward conveyor into a compartment within the interior of said dispenser.

16. Apparatus according to claim 15, including a diverter juxtaposed with the lower end of said downward conveyor and adapted to selectively cause said topmost sheet to be transferred to said exit conveyor or to said reject conveyor.

17. Apparatus according to claim 3, wherein said scissors linkage comprises first and second links pivotally connected together at their medial portions, one end of said first link being connected in fixed relation to said dispenser, the other end of said first link having a roller for engaging the lower surface of said platform, one end of said second link being pivotally connected to said platform, a support plate connected in fixed relationship beneath said platform, said second link having a roller at its other end adapted to roll on said support plate.

18. Apparatus according to claim 4, wherein said sensing means comprises a shaft fixed in position relative to said dispensing means, a generally vertical lever having its upper end supported by said shaft, said lever having camming means juxtaposed with the movement of said topmost sheet and adapted to be cammed away from said topmost sheet by an amount corresponding to the thickness thereof, and switch means mounted adjacent the lower edge of said lever on the side thereof away from the downward path of said sheet, said switch means being adapted to be operated by the lower end of said lever in response to downward movement of said sheet, said switch means being adjustably mounted in relation to said dispenser.

19. Apparatus according to claim 1, wherein said roller has a surface of soft gum rubber.

20. A dispenser for dispensing sheets of currency one sheet at a time, comprising means for supporting a stack of currency sheets, a feed roller having eccentric means continuously engaged with the topmost sheet in said stack, pressure means for continuously pressing said stack into contact with said feed roller, means for rotating said feed roller for urging said topmost sheet forwardly relative to said stack, means for sensing the advancement of said topmost sheet for de-energizing said feed roller in response to said advancement, and conveyor means for carrying said advanced topmost sheet to an exit port to dispense said sheet.

21. Apparatus according to claim 20, wherein said pressure means includes jogging means for incrementally and cyclically increasing and decreasing the force with which said stack is pressed into contact with said feed roller.

* * * * *